US009393673B2

(12) United States Patent
Eilers et al.

(10) Patent No.: US 9,393,673 B2
(45) Date of Patent: Jul. 19, 2016

(54) COATED ABRASIVE ARTICLE

(71) Applicant: 3M INNOVATIVE PROPERTIES COMPANY, St. Paul, MN (US)

(72) Inventors: Deborah J. Eilers, Hastings, MN (US); Jeffrey R. Janssen, Hernando, FL (US)

(73) Assignee: 3M Innovative Properties Company, St. Paul, MN (US)

( * ) Notice: Subject to any disclaimer, the term of this patent is extended or adjusted under 35 U.S.C. 154(b) by 30 days.

(21) Appl. No.: 14/413,067

(22) PCT Filed: Jun. 26, 2013

(86) PCT No.: PCT/US2013/047742

§ 371 (c)(1),
(2) Date: Jan. 6, 2015

(87) PCT Pub. No.: WO2014/008049

PCT Pub. Date: Jan. 9, 2014

(65) Prior Publication Data

US 2015/0126098 A1 May 7, 2015

Related U.S. Application Data

(60) Provisional application No. 61/668,587, filed on Jul. 6, 2012.

(51) Int. Cl.

| | |
|---|---|
| ***B24D 3/28*** | (2006.01) |
| ***B24D 11/00*** | (2006.01) |
| ***B24D 11/04*** | (2006.01) |

(52) U.S. Cl.
CPC *B24D 3/28* (2013.01); *B24D 11/00* (2013.01); *B24D 11/04* (2013.01)

(58) Field of Classification Search
CPC ..... B24D 3/28; B24D 11/00; B24D 11/04
USPC ..... 451/529
See application file for complete search history.

(56) References Cited

U.S. PATENT DOCUMENTS

| | | | |
|---|---|---|---|
| 4,594,262 | A | 6/1986 | Kreil |
| 4,751,138 | A | 6/1988 | Tumey |

(Continued)

FOREIGN PATENT DOCUMENTS

| | | |
|---|---|---|
| EP | 0 546 732 | 6/1993 |
| JP | H08-71927 A | 3/1996 |

(Continued)

*Primary Examiner* — George Nguyen
(74) *Attorney, Agent, or Firm* — Philip P. Soo

(57) ABSTRACT

Provided are abrasive articles in which the make layer, abrasive particle layer, and size layer are coated onto a backing according to a coating pattern characterized by a pattern of discrete islands, or features, having an areal density ranging from about 30 features to about 300 features per square centimeter and an average feature diameter ranging from about 0.1 millimeters to about 1.5 millimeters. Optionally, the provided abrasive particles have an average abrasive particle size ranging from about 20 micrometers to about 250 micrometers and the average make layer thickness ranging from 33 percent to 100 percent of the average abrasive particle size. This coating pattern provides that all three components are generally in registration with each other, while also providing a pervasive uncoated area extending across the backing, thereby providing improved cut and finish performance while displaying a resistance to curl in wet environments.

17 Claims, 4 Drawing Sheets

(56) References Cited

U.S. PATENT DOCUMENTS

| | | | | |
|---|---|---|---|---|
| 4,759,982 | A | 7/1988 | Janssen | |
| 4,828,583 | A | 5/1989 | Oxman | |
| 4,877,657 | A | 10/1989 | Yaver | |
| 4,988,554 | A | 1/1991 | Peterson | |
| 5,551,960 | A * | 9/1996 | Christianson | A47L 13/28 51/295 |
| 5,891,967 | A | 4/1999 | Strobel | |
| 5,900,317 | A | 5/1999 | Strobel | |
| 6,352,758 | B1 | 3/2002 | Huang | |
| 6,383,064 | B1 | 5/2002 | Eggert | |
| 6,428,405 | B1 * | 8/2002 | Tsuchiya | B24B 37/26 451/526 |
| 6,458,018 | B1 * | 10/2002 | Goers | B24B 7/241 451/41 |
| 6,682,574 | B2 | 1/2004 | Carter | |
| 6,773,474 | B2 | 8/2004 | Koehnle | |
| 7,150,770 | B2 | 12/2006 | Keipert | |
| 7,329,175 | B2 | 2/2008 | Woo | |
| 2002/0151253 | A1 * | 10/2002 | Kollodge | B24D 11/00 451/41 |
| 2004/0235406 | A1 * | 11/2004 | Duescher | B24D 11/001 451/527 |
| 2005/0245179 | A1 * | 11/2005 | Luedeke | B24B 5/42 451/59 |
| 2007/0231495 | A1 | 10/2007 | Ciliske | |
| 2007/0234954 | A1 | 10/2007 | Ciliske | |
| 2009/0169816 | A1 | 7/2009 | Erickson | |
| 2011/0244769 | A1 | 10/2011 | David | |
| 2012/0000135 | A1 * | 1/2012 | Eilers | B24D 3/28 51/295 |
| 2014/0308884 | A1 * | 10/2014 | Janssen | B24D 3/28 451/529 |

FOREIGN PATENT DOCUMENTS

| | | |
|---|---|---|
| WO | WO 97/11484 | 3/1997 |
| WO | WO 2012/003116 | 1/2012 |

* cited by examiner

COATED ABRASIVE ARTICLE

CROSS REFERENCE TO RELATED APPLICATIONS

This application is a national stage filing under 35 U.S.C. 371 of PCT/US2013/047742, filed Jun. 26, 2013, which claims priority to U.S. Provisional Patent Application No. 61/668,587, filed Jul. 6, 2012, the disclosures of which are incorporated by reference in their entirety herein.

FIELD OF THE INVENTION

Coated abrasive articles are provided along with methods of making the same. More particularly, coated abrasive articles with patterned coatings are provided, along with methods of making the same.

BACKGROUND

Coated abrasive articles are commonly used for abrading, grinding and polishing operations in both commercial and industrial applications. These operations are conducted on a wide variety of substrates, including wood, wood-like materials, plastics, fiberglass, soft metals, enamel surfaces, and painted surfaces. Some coated abrasives can be used in either wet or dry environments. In wet environments, common applications include filler sanding, putty sanding, primer sanding and paint finishing.

In general, these abrasive articles include a paper or polymeric backing on which abrasive particles are adhered. The abrasive particles may be adhered using one or more tough and resilient binders to secure the particles to the backing during an abrading operation. In a manufacturing process, these binders are often processed in a flowable state to coat the backing and the particles, and then subsequently hardened to lock in a desired structure and provide the finished abrasive product.

In a common construction, the backing has a major surface that is first coated with a "make" layer. Abrasive particles are then deposited onto the make layer such that the particles are at least partially embedded in the make layer. The make layer is then hardened (e.g., crosslinked) to secure the particles. Then, a second layer called a "size" layer is coated over the make layer and abrasive particles and also hardened. The size layer further stabilizes the particles and also enhances the strength and durability of the abrasive article. Optionally, additional layers may be added to modify the properties of the coated abrasive article.

A coated abrasive article can be evaluated based on certain performance properties. First, such an article should have a desirable balance between cut and finish—that is, an acceptable efficiency in removing material from the workpiece, along with an acceptable smoothness of the finished surface. Second, an abrasive article should also avoid excessive "loading", or clogging, which occurs when debris or swarf become trapped between the abrasive particles and hinder the cutting ability of the coated abrasive. Third, the abrasive article should be both flexible and durable to provide for longevity in use.

Wet abrasive applications can provide unique challenges. Abrasive sheets may be soaked in water for extended periods of time, sometimes for more than 24 hours. A particular problem encountered with commercial coated abrasive articles in wet environments is the tendency for these coated articles to curl. Curling of the abrasive article can be a significant nuisance to the user. A similar effect can also occur when abrasive articles are stored in humid environments. To mitigate curling, abrasive sheets are sometimes pre-flexed in the manufacturing process, but this is generally ineffective in preventing curling during use.

The present disclosure provides coated abrasive articles in which the make layer, abrasive particle layer, and size layer are coated onto a backing in a discontinuous coating pattern. All three components are substantially in registration with each other according to discrete pattern features, thereby providing pervasive uncoated areas extending across the backing. The features optionally have an areal density ranging from about 30 features to about 300 features per square centimeter and an average feature diameter ranging from about 0.1 millimeters to about 1.5 millimeters. The provided abrasive particles optionally have an average abrasive particle size ranging from about 20 micrometers to about 250 micrometers and the average make layer thickness ranging from 33 percent to 100 percent of the average abrasive particle size. Advantageously, this configuration provides a coated abrasive that displays superior curl-resistance and improved overall cut and finish performance as compared with prior art abrasive articles.

In one aspect, an abrasive article is provided. The abrasive article comprises: a flexible backing having a major surface; a make resin contacting the major surface and extending across the major surface in a pre-determined pattern; abrasive particles contacting the make resin and generally in registration with the make resin as viewed in directions normal to the plane of the major surface; and a size resin contacting both the abrasive particles and the make resin, the size resin being generally in registration with both the abrasive particles and the make resin as viewed in directions normal to the plane of the major surface, wherein areas of the major surface contacting the make resin are generally coplanar with areas of the major surface not contacting the make resin, and wherein the pre-determined pattern comprises a multiplicity of features having an areal density ranging from about 30 features to about 300 features per square centimeter and an average feature diameter ranging from about 0.1 millimeters to about 1.5 millimeters.

In another aspect, an abrasive article is provided comprising: a flexible backing having a major surface; a make resin contacting the major surface and extending across the major surface in a pre-determined pattern, the make resin layer having an average make layer thickness; abrasive particles contacting the make resin and generally in registration with the make resin as viewed in directions normal to the plane of the major surface, the abrasive particles having an average abrasive particle size ranging from about 20 micrometers to about 250 micrometers and the average make layer thickness ranging from 33 percent to 100 percent of the average abrasive particle size; and a size resin contacting both the abrasive particles and the make resin, the size resin being generally in registration with both the abrasive particles and the make resin as viewed in directions normal to the plane of the major surface, wherein areas of the major surface contacting the make resin are generally coplanar with areas of the major surface not contacting the make resin.

In still another aspect, an abrasive article is provided, comprising: a flexible backing having a generally planar major surface; and a plurality of discrete islands on the major surface arranged according to a two-dimensional pattern, each island comprising: a make resin contacting the backing; abrasive particles contacting the make resin; and a size resin contacting the make resin, the abrasive particles, and the backing, wherein areas of the major surface surrounding the islands do not contact the make resin, abrasive particles, or size resin, and wherein the pre-determined pattern comprises a multiplicity of features having an areal density ranging from about 30 features to about 300 features per square centimeter and an average feature diameter ranging from about 0.1 millimeters to about 1.5 millimeters.

In yet another aspect, an abrasive article comprising: a flexible backing having a generally planar major surface; and a plurality of discrete islands on the major surface arranged according to a two-dimensional pattern, each island comprising: a make resin contacting the backing, the make resin layer having an average make layer thickness; abrasive particles contacting the make resin, the abrasive particles having an average abrasive particle size ranging from about 20 micrometers to about 250 micrometers and the average make layer thickness ranging from 33 percent to 100 percent of the average abrasive particle size; and a size resin contacting the make resin, the abrasive particles, and the backing, wherein areas of the major surface surrounding the islands do not contact the make resin, abrasive particles, or size resin.

DEFINITIONS

As used herein:

"Feature" refers to an image that is defined by a selective coating process;

"Coverage" refers to the percentage of surface area of the backing eclipsed by the features over the area subjected to the selective coating process;

"Diameter" refers to the longest dimension of an object;

"Particle size" refers to the longest dimension of the particle; and

"Cluster" refers to a group of features located in proximity to each other.

DETAILED DESCRIPTION

Figure 1:
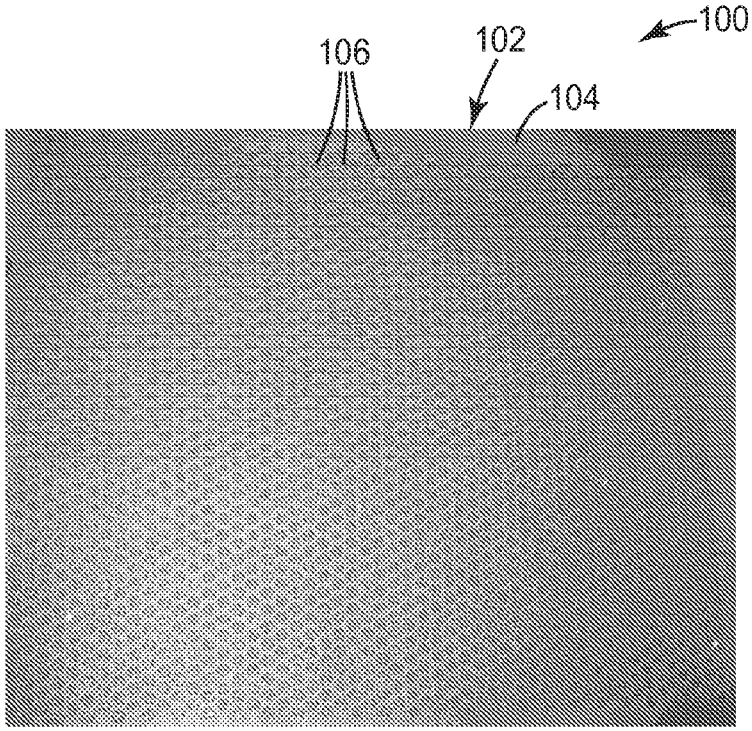
FIG. 1 is a plan view of an abrasive article according to one embodiment.

An abrasive article according to one exemplary embodiment is shown in FIG. 1 and is designated by the numeral 100. As shown, the abrasive article 100 includes a backing 102 having a planar major surface 104 approximately parallel to the plane of the page. A plurality of discrete clusters 106 are located on the major surface 104 and arranged in a predetermined pattern. In this embodiment, the pattern is a two-dimensional ordered array. The abrasive article 100 occupies a planar rectangular region corresponding to the patterned region shown in FIG. 1.

Figure 2A:
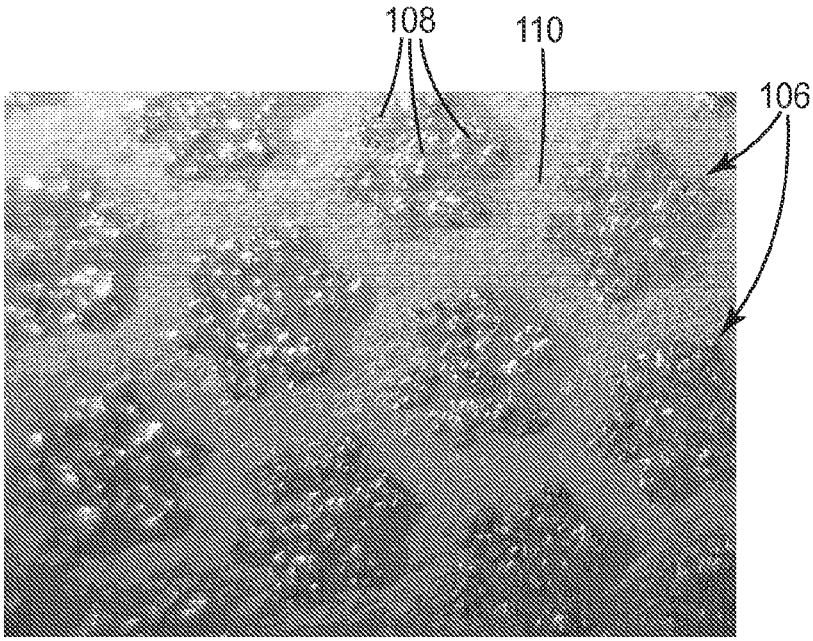
FIG. 2*a* is an enlarged view of a portion of the abrasive article in FIG. 1.

FIG. 2 shows the pattern of clusters 106 in greater detail. As shown in the figure, the clusters 106 are arranged in a hexagonal array in which each cluster 106 has six equidistant neighbors (excluding edge effects). Further, each individual cluster 106 is itself a hexagonal grouping of seven discrete abrasive features 108. As shown, each of the features 108 is generally circular in shape. However, other shapes such as squares, rectangles, lines and arcs, may also be used. In other embodiments, the features 108 are not clustered.

Notably, there are uncoated areas 110 of the major surface 104 surrounding each cluster 106 and located between neighboring clusters 106. Advantageously, during an abrading operation, the uncoated areas 110 provide open channels allowing swarf, dust, and other debris to be evacuated from the cutting areas where the features 108 contact the workpiece.

Figure 2B:
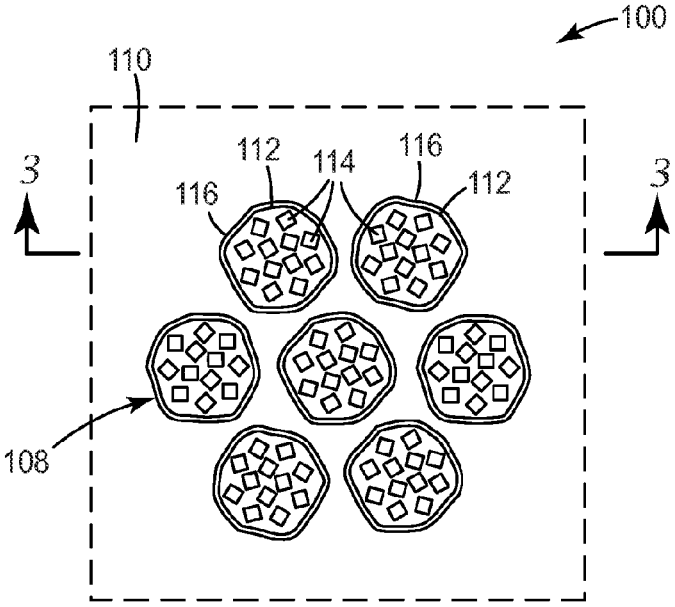
FIG. 2*b* is a further enlarged view of a sub-portion of the abrasive article in FIGS. 1 and 2*a;*
Figure 3:
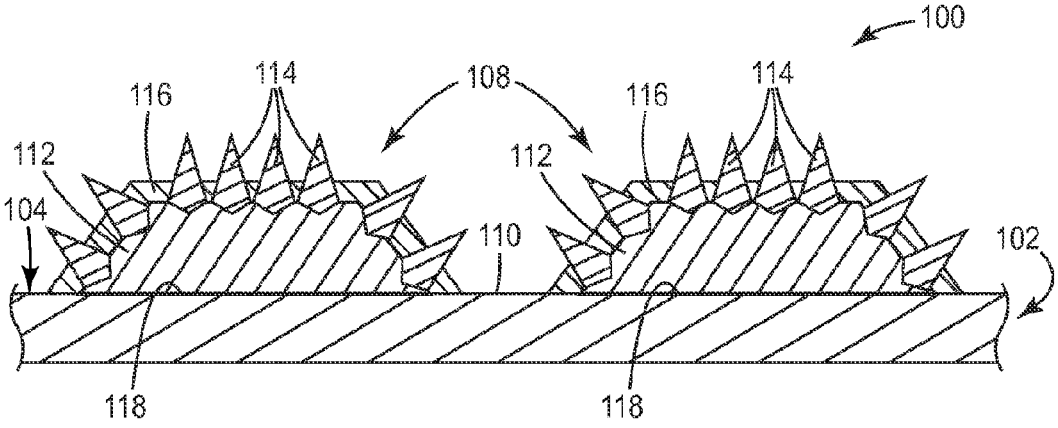
FIG. 3 is a cross-sectional view of the sub-portion of the abrasive article shown in FIGS. 1, 2*a*, and 2*b;*

FIG. 2*b* shows components of the features 108 in further detail and FIG. 3 shows two of the features 108 in cross-section. As shown in these figures, each feature 108 includes a layer of make resin 112 that is preferentially deposited onto the major surface 104 along an interface 118. The make resin 112 coats selective areas of the backing 102, thereby forming the base layer for each discrete feature 108, or "island", on the backing 102.

A plurality of abrasive particles 114 contact the make resin 112 and generally extend in directions away from the major surface 104. The particles 114 are generally in registration with the make resin 112 when viewed in directions normal to the plane of the major surface 104. In other words, the particles 114, as a whole, generally extend across areas of the major surface 104 that are coated by the make resin 112, but do not generally extend across areas of the major surface 104 that are not coated by the make resin 112. Optionally, the particles 114 are at least partially embedded in the make resin 112.

As further shown in FIG. 3, a size resin 116 contacts both the make resin 112 and the particles 114 and extends on and around both the make resin 112 and the particles 114. The size resin 116 is generally in registration with both the make resin 112 and the particles 114 when viewed in directions normal to the plane of the major surface 104. Like the abrasive particles 114, the size resin 116 generally extends across areas of the major surface 104 coated by the make resin 112, but does not generally extend across areas of the major surface 104 not coated by the make resin 112.

Optionally and as shown, the size resin 116 contacts the make resin 112, the abrasive particles 114, and the backing 102. As another option, essentially all of the abrasive particles 114 are encapsulated by the combination of the make and size resins 112, 116.

While the particles 114 are described here as being "generally in registration" with the make resin 112, it is to be understood that the particles 114 themselves are discrete in nature and have small gaps located between them. Therefore, the particles 114 do not cover the entire area of the underlying make resin 112. Conversely, it is to be understood that while the size resin 116 is "in registration" with make resin 112 and the particles 114, size resin 116 can optionally extend over a slightly oversized area compared with that covered by the make resin 112 and particles 114, as shown in FIG. 2*b*. In the embodiment shown, the make resin 112 is fully encapsulated by the size resin 116, the particles 114, and the backing 102.

In some embodiments, the pattern comprises a multiplicity of features having an areal density of at least about 30 features, at least about 32 features, at least about 35 features, at least about 40 features, or at least about 45 features per square centimeter. In some embodiments, the pattern comprises a multiplicity of features having an areal density of at most about 300 features, at most about 275 features, at most about 250 features, at most about 225 features, or at most about 200 features per square centimeter. Optionally, the features could have an average feature diameter of at least about 0.1 millimeters, at least about 0.15 millimeters, or at least about 0.25 millimeters. As a further option, the average feature diameter could be at most about 1.5 millimeters, at most about 1 millimeter, or at most about 0.5 millimeters. These configurations were observed to provide a significant and surprising improvement in overall cut and finish performance compared with prior abrasive articles disclosed in the art.

Further, all of the features 108 on the backing 102 need not be discrete. For example, the make resin 112 associated with adjacent features 108 may be in such close proximity that the features 108 contact each other, or become interconnected. In some embodiments, two or more features 108 may be interconnected with each other within a cluster 106, although the features 108 in separate clusters 106 are not interconnected.

In some embodiments, there may be regions on the major surface 104 of the backing 102 surrounding the features 108 that are coated with make resin 112 and/or size resin 116 but do not include the particles 114. It is to be understood that the presence of one or more additional resin islands, each of which does not include one or more of the make resin 112, size resin 116, and particles 114 may not significantly degrade the performance of the abrasive article 100. Moreover, the presence of such resin islands should not be construed to negate the registration of these components relative to each other in the features 108.

Preferably and as shown, the backing 102 is uniform in thickness and generally flat. As a result, the interface 118 where the major surface 104 contacts the make resin 112 is generally coplanar with the areas of the major surface 104 that do not contact the make resin 112 (i.e. uncoated areas 110). A backing 102 with a generally uniform thickness is preferred to alleviate stiffness variations and improve conformability of the article 100 to the workpiece. This aspect is further advantageous because it evenly distributes the stress on the backing, which improves durability of the article 100 and extends its operational lifetime.

The provided abrasive articles present a solution to particular problems with conventional coated abrasive sheets. One problem is that conventional abrasive sheets tend to curl in humid environments. Another problem is that these coated abrasive sheets often curl immediately when made, a phenomenon known as "intrinsic curl." To mitigate intrinsic curl, manufacturers can pre-flex these abrasive sheets, but this involves additional processing and still does not effectively address curl that is subsequently induced by the environment.

Unlike conventional abrasive articles, the provided abrasive articles have abrasive particles extending across a plurality of islands, or discrete coated regions, along the major surface, while uncoated areas of the major surface are maintained between the islands. It was discovered that when areas of the major surface surrounding these islands do not contact any of the make resin, abrasive particles, or size resin, these abrasive articles display superior resistance to curling when immersed in water or subjected to humid environments.

Additionally, these abrasive articles have substantially reduced curl when manufactured and reduce the need for pre-flexing of the abrasive sheets after the make and size resins have been hardened. When tested in accordance with the Dry Curl test (described in the Examples section below), the abrasive articles preferably display a curl radius of at least 20 centimeters, more preferably display a curl radius of at least 50 centimeters, and most preferably display a curl radius of at least 100 centimeters. When tested in accordance with the Wet Curl test (described in the Examples section below), the abrasive articles preferably display a curl radius of at least 2 centimeters, more preferably display a curl radius of at least 5 centimeters, and most preferably display a curl radius of at least 7 centimeters.

As a further advantage, these abrasive articles have been found to display a high degree of flexibility, since a substantial portion of the backing is uncoated. The greater flexibility in turn enhances durability. This is particularly shown by its high resistance to tearing and delamination when the abrasive article is subjected to crumpling under wet and dry conditions.

Other Coating Patterns

The abrasive article 100 described above uses a two-dimensional hexagonal coating pattern for the features 108. While the pattern is two-dimensional, the features 108 themselves have some thickness that results in a "feature height" perpendicular to the plane of the backing. However, other coating patterns are also possible, with some offering particular advantages over others.

In some embodiments, the pattern includes a plurality of replicated polygonal clusters and/or features, including ones in the shape of triangles, squares, rhombuses, and the like. For example, triangular clusters could be used where each cluster has three or more generally circular abrasive features. Since the abrasive features 108 increase the stiffness of the underlying backing 102 on a local level, the pattern of the abrasive article 100 may be tailored to have enhanced bending flexibility along preferred directions.

Figure 4:
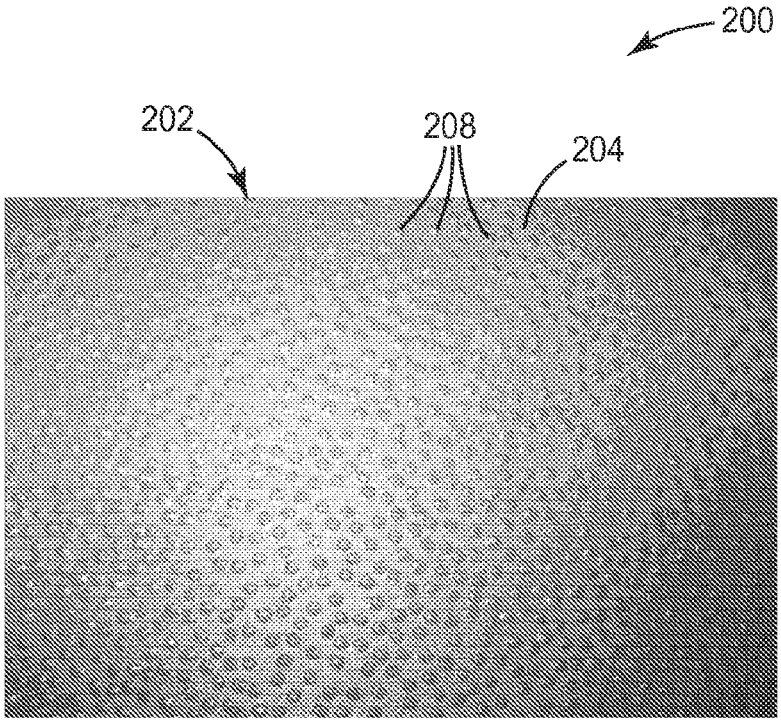
FIG. 4 is a plan view of an abrasive article according to another embodiment.

The coating pattern need not be ordered. For example, FIG. 4 shows an abrasive article 200 according to an alternative embodiment displaying a pattern that includes a random array of features. Like the article 100, the article 200 has a backing 202 with a major surface 204 and an array of discrete and generally circular abrasive features 208 that contact, and extend across, the major surface 204. However, the article 200 differs in that the features 208 are random. Optionally, the features 208 may be semi-random, or have limited aspects that are ordered. Advantageously, random patterns are non-directional within the plane of the major surface of the backing, helping minimize variability in cut performance. As a further advantage, a random pattern helps avoid creating systematic lines of weakness which may induce curling of the abrasive article along those directions.

Other aspects of article 200, including the configuration of the abrasive features 208, are analogous to those of article 100 and shall not be repeated here. Like reference numerals refer to like elements described previously.

The abrasive articles 100, 200 preferably have an abrasive coverage (measured as a percentage of the major surface 104) that fits the desired application. On one hand, increasing abrasive coverage advantageously provides greater cutting area between the abrasive particles 114 and the workpiece. On the other hand, decreasing abrasive coverage increases the size of the uncoated areas 110. Increasing the size of the uncoated areas 110, in turn, can provide greater space to clear dust and debris and help prevent undesirable loading during an abrading operation.

Advantageously, low levels of abrasive coverage were nonetheless found to provide very high levels of cut, despite the relatively small cutting area between abrasive and the workpiece. In particular, it was found that fine grade abrasives could be coated onto the backing 102, 202 at less than 50 percent coverage while providing cut performance similar to that of a fully coated sheet. Similarly, it was found that coarse grade abrasives could be coated onto the backing 102, 202 at less than 20 percent coverage while providing cut performance similar to that of a fully coated sheet.

In some embodiments, the abrasive particles 114 have an average size (i.e. average abrasive particle size) ranging from about 70 micrometers to 250 micrometers, while the make resin 112 preferably covers at most 30 percent, more preferably at most 20 percent, and most preferably at most 10 percent of the major surface 104, 204 of the backing 102, 202. In other embodiments, the abrasive particles 114 have an average size ranging from about 20 micrometers to 70 micrometers, while the make resin 112 covers preferably at most 70 percent, more preferably at most 60 percent, and most preferably at most 50 percent of the major surface 104, 204 of the backing 102, 202.

The thickness of the make resin on the backing can also have a substantial effect on the cut and finish performance of the abrasive article. The average layer thickness of the make resin can be selected at least in part based on the average abrasive particle size of the abrasive particles 114. Preferably, the average make layer thickness is at least about 33 percent, at least about 40 percent, or at least about 50 percent of the average abrasive particle size. It is further preferable that the average make layer thickness is at most about 100 percent, at most about 80 percent, or at most about 60 percent of the average abrasive particle size.

It was discovered that the height of the make/mineral and size combination can have a surprising and significant impact on abrasive performance. If the make resin height is too low, mineral anchorage can be compromised. If the height of the make resin is excessive, the mineral can be fully embedded in the fluid make resin, hiding the cutting surface of the mineral. Finally, if the height of the make resin is excessive and the mineral does not become embedded but is instead fully exposed, the finish of the resulting sanding operation can be compromised. It is believed that these effects influence the desirable ranges for the height of the make coat resin and the combination of the make resin/mineral and size coat resin.

Backings

The backing 102 may be constructed from various materials known in the art for making coated abrasive articles, including sealed coated abrasive backings and porous non-sealed backings. Preferably, the thickness of the backing generally ranges from about 0.02 to about 5 millimeters, more preferably from about 0.05 to about 2.5 millimeters, and most preferably from about 0.1 to about 0.4 millimeters, although thicknesses outside of these ranges may also be useful.

The backing may be made of any number of various materials including those conventionally used as backings in the manufacture of coated abrasives. Exemplary flexible backings include polymeric film (including primed films) such as polyolefin film (e.g., polypropylene including biaxially oriented polypropylene, polyester film, polyamide film, cellulose ester film), metal foil, mesh, foam (e.g., natural sponge material or polyurethane foam), cloth (e.g., cloth made from fibers or yarns comprising polyester, nylon, silk, cotton, and/or rayon), scrim, paper, coated paper, vulcanized paper, vulcanized fiber, nonwoven materials, combinations thereof, and treated versions thereof. The backing may also be a laminate of two materials (e.g., paper/film, cloth/paper, film/cloth). Cloth backings may be woven or stitch bonded. In some embodiments, the backing is a thin and conformable polymeric film capable of expanding and contracting in transverse (i.e. in-plane) directions during use. Preferably, a strip of such a backing material that is 5.1 centimeters (2 inches) wide, 30.5 centimeters (12 inches) long, and 0.102 millimeters (4 mils) thick and subjected to a 22.2 Newton (5 Pounds-Force) dead load longitudinally stretches at least 0.1%, at least 0.5%, at least 1.0%, at least 1.5%, at least 2.0%, at least 2.5%, at least 3.0%, or at least 5.0%, relative to the original length of the strip. Preferably, the backing strip longitudinally stretches up to 20%, up to 18%, up to 16%, up to 14%, up to 13%, up to 12%, up to 11%, or up to 10%, relative to the original length of the strip. The stretching of the backing material can be elastic (with complete spring back), inelastic (with zero spring back), or some mixture of both. This property helps promote contact between the abrasive particles 114 and the underlying substrate, and can be especially beneficial when the substrate includes raised and/or recessed areas.

Highly conformable polymers that may be used in the backing 102 include certain polyolefin copolymers, polyurethanes, and polyvinyl chloride. One particularly preferred polyolefin copolymer is an ethylene-acrylic acid resin (available under the trade designation "PRIMACOR 3440" from Dow Chemical Company, Midland, Mich.). Optionally, ethylene-acrylic acid resin is one layer of a bilayer film in which the other layer is a polyethylene terephthalate (PET) carrier film. In this embodiment, the PET film is not part of the backing 102 itself and is stripped off prior to using the abrasive article 100.

In some embodiments, the backing 102 has a modulus of at least 10, at least 12, or at least 15 kilogram-force per square centimeter (kgf/cm$^2$). In some embodiments, the backing 102 has a modulus of up to 200, up to 100, or up to 30 kgf/cm$^2$. The backing 102 can have a tensile strength at 100% elongation (double its original length) of at least 200, at least 300, or at least 350 kgf/cm$^2$. The tensile strength of the backing 102 can be up to 900, up to 700, or up to 550 kgf/cm$^2$. Backings with these properties can provide various options and advantages, further described in U.S. Pat. No. 6,183,677 (Usui et al.).

The choice of backing material may depend on the intended application of the coated abrasive article. The thickness and smoothness of the backing should also be suitable to provide the desired thickness and smoothness of the coated abrasive article, wherein such characteristics of the coated abrasive article may vary depending, for example, on the intended application or use of the coated abrasive article.

The backing may, optionally, have at least one of a saturant, a presize layer and/or a backsize layer. The purpose of these materials is typically to seal the backing and/or to protect yarn or fibers in the backing. If the backing is a cloth material, at least one of these materials is typically used. The addition of the presize layer or backsize layer may additionally result in a 'smoother' surface on either the front and/or the back side of the backing. Other optional layers known in the art may also be used, as described in U.S. Pat. No. 5,700,302 (Stoetzel et al.).

Abrasive Particles

Suitable abrasive particles for the coated abrasive article 100 include any known abrasive particles or materials useable in abrasive articles. For example, useful abrasive particles include fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide) and metal sulfites (e.g., calcium sulfite), and metal particles (e.g., tin, lead, copper).

It is also possible to use polymeric abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), polymeric abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof. Other exemplary abrasive particles are described, for example, in U.S. Pat. No. 5,549,962 (Holmes et al.).

The abrasive particles typically have an average size ranging from about 0.1 to about 270 micrometers, and more desirably from about 1 to about 1300 micrometers. Coating weights for the abrasive particles may depend, for example, on the binder precursor used, the process for applying the abrasive particles, and the size of the abrasive particles, but typically range from about 5 to about 1350 grams per square meter.

Make and Size Resins

Any of a wide selection of make and size resins 112, 116 known in the art may be used to secure the abrasive particles 114 to the backing 102. The resins 112, 116 typically include one or more binders having rheological and wetting properties suitable for selective deposition onto a backing.

Typically, binders are formed by curing (e.g., by thermal means, or by using electromagnetic or particulate radiation) a binder precursor. Useful first and second binder precursors are known in the abrasive art and include, for example, free-radically polymerizable monomer and/or oligomer, epoxy resins, acrylic resins, epoxy-acrylate oligomers, urethane-acrylate oligomers, urethane resins, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

Exemplary radiation cured crosslinked acrylate binders are described in U.S. Pat. No. 4,751,138 (Tumey, et al.) and U.S. Pat. No. 4,828,583 (Oxman, et al.).

Supersize Resins

Optionally, one or more additional supersize resin layers are applied to the coated abrasive article 100. If a supersize resin is applied, it is preferably in registration with the make resin 112, particles 114, and size resin 116, as viewed in directions normal to the plane of the major surface of the backing. The supersize resin may include, for example, grinding aids and anti-loading materials. In some embodiments, the supersize resin provides enhanced lubricity during an abrading operation.

Curatives

Any of the make resin, size resin, and supersize resin described above optionally include one or more curatives. Curatives include those that are photosensitive or thermally sensitive, and preferably comprise at least one free-radical polymerization initiator and at least one cationic polymerization catalyst, which may be the same or different. In order to minimize heating during cure, while preserving pot-life of the binder precursor, the binder precursors employed in the present embodiment are preferably photosensitive, and more preferable comprise a photoinitiator and/or a photocatalyst.

Photoinitiators & Photocatalysts

The photoinitiator is capable of at least partially polymerizing (e.g., curing) free-radically polymerizable components of the binder precursor. Useful photoinitiators include those known as useful for photocuring free-radically polyfunctional acrylates. Exemplary photoinitiators include bis(2,4,6-trimethylbenzoyl)-phenylphosphineoxide, commercially available under the trade designation "IRGACURE 819" from BASF Corporation, Florham Park, N.J.; benzoin and its derivatives such as alpha-methylbenzoin; alpha-phenylbenzoin; alpha-allylbenzoin; alpha-benzylbenzoin; benzoin ethers such as benzil dimethyl ketal (e.g., as commercially available under the trade designation "IRGACURE 651" from BASF Corporation), benzoin methyl ether, benzoin ethyl ether, benzoin n-butyl ether; acetophenone and its derivatives such as 2-hydroxy-2-methyl-1-phenyl-1-propanone (e.g., as commercially available under the trade designation "DAROCUR 1173" from BASF Corporation. Photocatalysts as defined herein are materials that form active species that, if exposed to actinic radiation, are capable of at least partially polymerizing the binder precursor, e.g., an onium salt and/or cationic organometallic salt. Preferably, onium salt photocatalysts comprise iodonium complex salts and/or sulfonium complex salts. Aromatic onium salts, useful in practice of the present embodiments, are typically photosensitive only in the ultraviolet region of the spectrum. However, they can be sensitized to the near ultraviolet and the visible range of the spectrum by sensitizers for known photolyzable organic halogen compounds. Useful commercially available photocatalysts include an aromatic sulfonium complex salt having the trade designation "UVI-6976", available from Dow Chemical Co. Photoinitiators and photocatalysts useful in the present invention can be present in an amount in the range of 0.01 to 10 weight percent, desirably 0.01 to 5, most desirably 0.1 to 2 weight percent, based on the total amount of photocurable (i.e., crosslinkable by electromagnetic radiation) components of the binder precursor, although amounts outside of these ranges may also be useful.

Fillers

The abrasive coatings described above optionally comprise one or more fillers. Fillers are typically organic or inorganic particulates dispersed within the resin and may, for example, modify either the binder precursor or the properties of the cured binder, or both, and/or may simply, for example, be used to reduce cost. In coated abrasives, the fillers may be present, for example, to block pores and passages within the backing, to reduce its porosity and provide a surface to which the maker coat will bond effectively. The addition of a filler, at least up to a certain extent, typically increases the hardness and toughness of the cured binder. Inorganic particulate filler commonly has an average filler particle size ranging from about 1 micrometer to about 100 micrometers, more preferably from about 5 to about 50 micrometers, and sometimes even from about 10 to about 25 micrometers. Depending on the ultimate use of the abrasive article, the filler typically has a specific gravity in the range of 1.5 to 4.5. Preferably, the average filler particle size is significantly less than the average abrasive particle size. Examples of useful fillers include: metal carbonates such as calcium carbonate (in the form of chalk, calcite, marl, travertine, marble or limestone), calcium magnesium carbonate, sodium carbonate, and magnesium carbonate; silicas such as quartz, glass beads, glass bubbles and glass fibers; silicates such as talc, clays, feldspar, mica, calcium silicate, calcium metasilicate, sodium aluminosilicate, sodium-potassium alumina silicate, and sodium silicate; metal sulfates such as calcium sulfate, barium sulfate, sodium sulfate, aluminum sodium sulfate, and aluminum sulfate;

gypsum; vermiculite; wood flour; alumina trihydrate; carbon black; metal oxides such as calcium oxide (lime), aluminum oxide, titanium dioxide, alumina hydrate, alumina monohydrate; and metal sulfites such as calcium sulfite.

Viscosity Enhancers

Other useful optional additives in the present embodiment include viscosity enhancers or thickeners. These additives may be added to a composition of the present embodiment as a cost savings measure or as a processing aid, and may be present in an amount that does not significantly adversely affect properties of a composition so formed. Increase in dispersion viscosity is generally a function of thickener concentration, degree of polymerization, chemical composition or a combination thereof. An example of a suitable commercially available thickener is available under the trade designation "CAB-β-SIL M-5" from Cabot Corporation, Boston, Mass.

Other Functional Additives

Other useful optional additives in the present embodiment include anti-foaming agents, lubricants, plasticizers, grinding aids, diluents, coloring agents and process aids. Useful anti-foaming agents include "FOAMSTAR 5125" from Cognis Corporation, Cincinnati, Ohio. Useful process aids include acidic polyester dispersing agents which aid the dispersion of the abrasive particles throughout the polymerizable mixture, such as "BYK W-985" from Byk-Chemie, GmbH, Wesel, Germany.

Methods of Making

In one exemplary method of making the article 100, the make resin 112 is preferentially applied to the major surface 104 of the backing 102 in a plurality of discrete areas that provide a random or ordered array on the major surface 104 as illustrated, for example, in FIGS. 1 and 4. Next, abrasive particles 114 are applied to the discrete areas of the make resin 112, and the make resin 112 is hardened. Optionally, the mineral can be applied over the entire sheet and then removed from those areas that do not contain the make resin 112. A size resin is then preferentially applied over the abrasive particles 114 and the make resin 112 and in contact with backing 102 (but it is not applied to the open areas 110 on the backing 102). Finally, the size resin 116 is hardened to provide the abrasive article 100.

In more detail, the selective application of the make resin 112 and size resin 116 can be achieved using contact methods, non-contact methods, or some combination of both. Suitable contact methods include mounting a template, such as a stencil or woven screen, against the backing of the article to mask off areas that are not to be coated. Non-contact methods include inkjet-type printing and other technologies capable of selectively coating patterns onto the backing without need for a template.

One applicable contact method is stencil printing. Stencil printing uses a frame to support a resin-blocking stencil. The stencil forms open areas allowing the transfer of resin to produce a sharply-defined image onto a substrate. A roller or squeegee is moved across the screen stencil, forcing or pumping the resin or slurry past the threads of the woven mesh in the open areas.

Screen printing is also a stencil method of print making in which a design is imposed on a screen of silk or other fine mesh, with blank areas coated with an impermeable substance, and the resin or slurry is forced through the mesh onto the printing surface. Advantageously, printing of lower profile and higher fidelity features can be enabled by screen printing. Exemplary uses of screen printing are described in U.S. Pat. No. 4,759,982 (Janssen et al.).

Yet another applicable contact method uses a combination of screen printing and stencil printing, where a woven mesh is used to support a stencil. The stencil includes open areas of mesh through which make resin/size resin can be deposited in the desired pattern of discrete areas onto the backing. Another possible contact method for preparing these constructions is a continuous kiss coating operation where the size coat is coated in registration over the abrasive mineral by passing the sheet between a delivery roll and a nip roll, as exemplified in co-pending non-provisional U.S. Patent Application Publication No. 2012/0000135 (Eilers, et al.). Optionally, the acrylate make resin can be metered directly onto the delivery roll. The final coated material can then be cured to provide the completed article.

Figure 5:
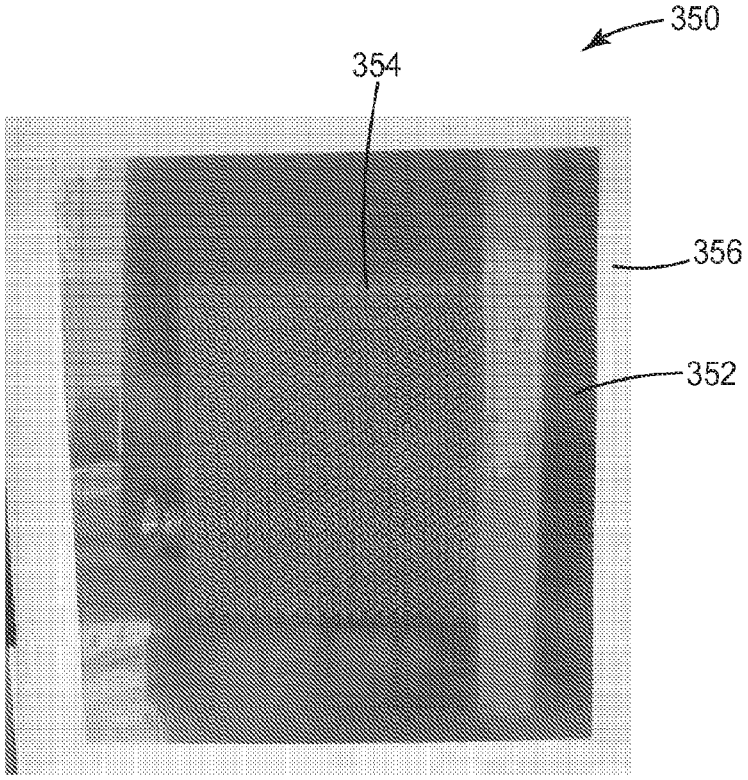
FIG. 5 is a plan view of a template providing the pattern for the features of the article in FIGS. 1-3.

FIG. 5 shows a stencil 350 for preparing the patterned coated abrasive articles shown in FIGS. 1-3. As shown, the stencil 350 includes a generally planar body 352 and a plurality of perforations 354 extending through the body 352. Optionally and as shown, a frame 356 surrounds the body on four sides. The stencil 350 can be made from a polymer, metal, or ceramic material and is preferably thin. Combinations of metal and woven plastics are also available. These provide enhanced flexibility of the stencil. Metal stencils can be etched into a pattern. Other suitable stencil materials include polyester films that have a thickness ranging from 1 to 20 mils (0.076 to 0.51 millimeters), more preferably ranging from 3 to 7 mils (0.13 to 0.25 millimeters).

Figure 6:
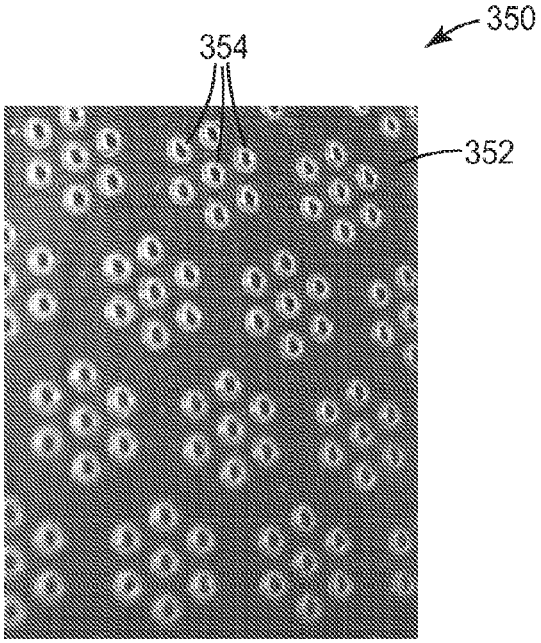
FIG. 6 is an enlarged fragmentary view of the template in FIG. 5, showing features of the template in greater detail.

FIG. 6 shows features of the stencil 350 in greater detail. As indicated in the figure, the perforations 354 assume the hexagonal arrangement of clusters and features as described previously for article 100. In some embodiments, the perforations are created in a precise manner by uploading a suitable digital image into a computer which automatically guides a laser to cut the perforations 354 into the stencil body 352.

The stencil 350 can be advantageously used to provide precisely defined coating patterns. In one embodiment, a layer of make resin 112 is selectively applied to the backing 102 by overlaying the stencil 350 on the backing 102 and applying the make resin 112 to the stencil 350. In some embodiments, the make resin 112 is applied in a single pass using a squeegee, doctor blade, or other blade-like device. Optionally, the stencil 350 is removed prior to hardening of the make resin 112. If so, the viscosity of the make resin 112 is preferably sufficiently high that there is minimal flow out that would distort the originally printed pattern.

In one embodiment, the mineral particles 114 can be deposited on the layer of make resin 112 using a powder coating process or electrostatic coating process. In electrostatic coating, the abrasive particles 114 are applied in an electric field, allowing the particles 114 to be advantageously aligned with their long axes normal to the major surface 104. In some embodiments, the mineral particles 114 are coated over the entire coated backing 102 and the particles 114 preferentially bond to the areas coated with the tacky make resin 112. After the particles 114 have been preferentially coated onto the make resin 112, the make resin 112 is then partially or fully hardened. In some embodiments, the hardening step occurs by subjecting the abrasive article 100 at elevated temperatures, exposure to actinic radiation, or a combination of both, to crosslink the make resin 112. Any excess particles 114 can then be removed from the uncoated areas of the backing 102.

In an exemplary final coating step, the stencil 350 is again overlaid on the coated backing 102 and positioned with the perforations 354 in registration with the previously hardened make resin 112 and abrasive particles 114. Then, the size resin 116 is preferentially applied to the hardened make resin 112 and abrasive particles 114 by applying the size resin 116 to the stencil 350. Preferably, the size resin 116 has an initial viscosity allowing the size resin 116 to flow and encapsulate exposed areas of the abrasive particles 114 and the make resin 112 prior to hardening. In some embodiments, the stencil 350 is removed prior to hardening of the size resin. Alternatively, the hardening occurs prior to removal of the stencil 350. Finally, the size resin 116 is hardened to provide the completed abrasive article 100.

Other Coating Methods

While screen printing or flexographic printing can provide precise and reproducible patterns, the fabrication of the screen or stencil 350 can incur significant labor and materials costs. These costs can be avoided by using an alternative coating method that obtains a patterned coating without need for a screen or stencil. Advantageously, each of the techniques described can be used to create a patterned coated abrasive where the pattern can range from highly random to one which is tightly controlled and predictable. Exemplary coating methods are described in the subsections below.

Spray Application

It can be advantageous to directly spray coat the make resin 112 onto the backing 102 to provide an irregular pattern of fine dots (or coated areas) that do not totally coalesce. The dot size and degree of coalescence can be controlled by several factors such as the air pressure, the nozzle size and geometry, the viscosity of the coating and the distance of the spray from the backing 102. The resulting spray pattern can be distinguished from the random dot pattern in the embodiment of FIG. 4 in that a spray-coated pattern is not pre-determined. Since no template is used, each coated abrasive article presents a unique two-dimensional configuration of dot sizes and distributions. Subsequent manufacturing steps also do not require a template. In one embodiment, for example, abrasive particles 114 are implanted into the make resin 112 by electrostatic coating such that the particles are at least partially embedded in the make layer. After curing of the make resin 112, the size resin 116 can then be deposited in registration with the particles 114 and/or make resin 112 using, for example, the continuous kiss coating operation previously described.

Controlled Wetting

Another approach uses a backing with a low surface energy. In one embodiment, the entire backing 102 could be made from a low surface energy material. Alternatively, a thin layer of a low surface energy material could be applied to the face of a conventional backing material. Low surface energy materials, which include fluorinated polymers, silicones, and certain polyolefins, can interact with liquids through dispersion (e.g. van der Waals) forces. When continuously coated over the backing 102, the make resin 112 can spontaneously "bead," or de-wet, from the low surface energy surface. In this manner, discrete islands of make resin 112 can be uniformly distributed across the backing 102 and then coated with the abrasive particles 114 and size resin 116 using techniques already described. Registration to the make resin 112 can be achieved, for example, by a kiss coating process or by the preferential wetting of the size resin 116 on the islands of make resin 112.

In another embodiment, the make resin 112 pattern can be facilitated by selective placement of a chemically dissimilar surface along the plane of the backing, thereby providing a chemically patterned surface. Chemical patterning can be achieved by placing a low energy surface pattern onto a high energy surface or, conversely, by placing a high energy surface pattern onto a low energy surface. This can be accomplished using any of various surface modification methods known in the art. Exemplary methods of surface treatment include, for example, corona treatment as described in U.S. Patent Publication No. 2007/0231495 (Ciliske et al.), 2007/0234954 (Ciliske et al.), and U.S. Pat. No. 6,352,758 (Huang et al.); flame-treating as described in U.S. Pat. No. 5,891,967 (Strobel et al.) and U.S. Pat. No. 5,900,317 (Strobel et al.); and electron-beam treatment as described in U.S. Pat. No. 4,594,262 (Kreil et al.).

Creation of such a patterned layer could also be facilitated, for example, by mechanically abrading or embossing the backing. These methods are described in detail in U.S. Pat. No. 4,877,657 (Yaver). As another possibility, a low surface energy backing may be used in combination with the spray application concept described above.

Powder Coating

Coating methods may also include methods in which the resin is deposited in the solid state. This can be accomplished, for example, by powder coating the backing 102 with suitably sized polymeric beads. The polymeric beads could be made from polyamide, epoxy, or some other make resin 112 and have a size distribution enabling the beads to be evenly distributed across the coated surface. Optionally, heat is then applied to partially or fully melt the polymeric beads and form discrete islands of make resin 112. While the resin is tacky, the resin islands can be coated with a suitable abrasive particles 114 and the resin allowed to harden. In a preferred embodiment, the abrasive-coated regions are then preferentially coated with the size resin 116 using, for example, a continuous kiss coating process. Optionally, a surface modified backing as described above could be used to avoid coalescence of the resin islands during coating processes.

Powder coating offers notable advantages, including the elimination of volatile organic compound (VOC) emissions, ability to easily recycle overspray, and general reduction of hazardous waste produced in the manufacturing process.

Optional Features

If desired, the abrasive articles 100, 200 may include one or more additional features that further enhance ease of use, performance or durability. For example, the articles optionally include a plurality of dust extraction holes that are connected to a source of vacuum to remove dust and debris from the major surface of the abrasive articles.

As another option, the backing 102, 202 may include a fibrous material, such as a scrim or non-woven material, facing the opposing direction from the major surface 104, 204. Advantageously, the fibrous material can facilitate coupling the article 100, 200 to a power tool. In some embodiments, for example, the backing 102, 202 includes one-half of a hook and loop attachment system, the other half being disposed on a plate affixed to the power tool. Alternatively, a pressure sensitive adhesive may be used for this purpose. Such an attachment system secures the article 100, 200 to the power tool while allowing convenient replacement of the article 100, 200 between abrading operations.

Additional options and advantages of these abrasive articles are described in U.S. Pat. No. 4,988,554 (Peterson, et al.), U.S. Pat. No. 6,682,574 (Carter, et al.), U.S. Pat. No. 6,773,474 (Koehnle et al.), and U.S. Pat. No. 7,329,175 (Woo et al.)

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used to describe the examples:

° C.: degrees Centigrade
° F.: degrees Fahrenheit
cm: centimeter
DC: direct current
ft/min feet per minute
kg: kilogram
m/min. meters per minute
mil: $10^{-3}$ inches
mJ/cm$^2$ millijoules per square centimeter
mil: $10^{-6}$ inches
μm: micrometer
oz: ounce
UV: ultraviolet
W: Watt
in$^2$: square inch
cm$^2$: square centimeter AWT: An A-weight olive brown paper, obtained from Wausau Paper Company, Wausau, Wis., subsequently saturated with a styrene-butadiene rubber, in order to make it waterproof.

CM-5: A fumed silica, obtained under the trade designation "CAB-O-SIL M-5" from Cabot Corporation, Boston, Mass.

CPI-6976: A triarylsulfonium hexafluoroantimonate/propylene carbonate photoinitiator, obtained under the trade designation "CYRACURE CPI 6976" from Dow Chemical Company, Midland, Mich.

CWT: A C-weight olive brown paper, obtained from Wausau Paper Company, subsequently saturated with a styrene-butadiene rubber, in order to make it waterproof.

D-1173: A α-Hydroxyketone photoinitiator, obtained under the trade designation "DAROCUR 1173" from BASF Corporation, Florham Park, N.J.

EPON-828: A difunctional bisphenol-A epoxy/epichlorohydrin derived resin having an epoxy equivalent wt. of 185-192, obtained under the trade designation "EPON 828" from Hexion Specialty Chemicals, Columbus, Ohio.

FEPA P150: A 150 grade silicon carbide mineral, obtained from UK Abrasives, Inc., Northbrook, Ill.

FEPA P320: A 320 grade silicon carbide mineral, obtained from UK Abrasives, Inc.

FEPA P600: A 600 grade silicon carbide mineral, obtained from UK Abrasives, Inc.

GC-80: An 80 grade silicon carbide mineral, obtained under the trade name "CARBOREX C-5-80" from Washington Mills Electro Minerals Corporation, Niagara Falls, N.Y.

I-819: A bis-acyl phosphine photoinitiator, obtained under the trade designation "IRGACURE 819" from BASF Corporation.

MX-10: A sodium-potassium alumina silicate filler, obtained under the trade designation "MINEX 10" from The Cary Company, Addison, Ill.

SR-351: trimethylol propane triacrylate, available under the trade designation "SR351" from Sartomer USA, LLC, Exton, Pa.

UVPC: A UV pigment concentrate, obtained under the trade designation "CARB VIOLET UV PASTE TMPTA-S9S93" from Penn Color, Inc., Doylestown, Pa.

UVR-6110: 3,4-epoxy cyclohexylmethyl-3,4-epoxy cyclohexylcarboxylate, obtained from Daicel Chemical Industries, Ltd., Tokyo, Japan.

W-985: An acidic polyester surfactant, obtained under the trade designation "BYK W-985" from Byk-Chemie, GmbH, Wesel, Germany.

Testing

Cut Test 1.

Coated abrasives were laminated to a dual sided adhesive film, and die cut into 4-inch (10.2 cm) diameter discs. The laminated coated abrasive was secured to the driven plate of a Schiefer Abrasion Tester, obtained from Frazier Precision Co., Gaithersburg, Md., which had been plumbed for wet testing. Disc shaped cellulose acetate butyrate (CAB) acrylic plastic workpieces, 4-inch (10.2 cm) outside diameter by 1.27 cm thick, available under the trade designation "POLY-CAST" were obtained from Preco Laser, Somerset, Wis. The initial weight of each workpiece was recorded prior to mounting on the workpiece holder of the Schiefer tester. The water flow rate was set to 60 grams per minute. A 14 pound (6.36 kg) weight was placed on the abrasion tester weight platform and the mounted abrasive specimen lowered onto the workpiece and the machine turned on. The machine was set to run for 500 cycles and then automatically stop. After each set of 500 cycles of the test, the workpiece was rinsed with water, dried and weighed. The cumulative cut for each 500-cycle set was the difference between the initial weight and the weight following each test, and is reported as the average value of 4 measurements.

Cut Test 2.

Primer coated test panels were prepared as follows. The surface of 18 by×24 inch (45.72 by 60.96 cm) steel panels were cleaned using compressed air, then sprayed with a cleaner, type "DX300 WAX & GREASE REMOVER" obtained from PPG Industries, Pittsburgh, Pa., and wiped dry using paper towels. A surface primer was prepared according to PPG Industries recommendations:

4 parts by volume: ENVIROBASE HIGH PERFORMANCE ECP15

1 parts by volume" STANDARD UNDERCOAT HARDENER EH391

10% by volume, or as needed: REDUCER DT870

Using a spray gun, model "3M ACCUSPRAY HG09" from 3M Company, St. Paul, Minn., three successive wet coats of the surface primer were applied to the panel. Flash time between each wet coat was five minutes at 23° C. After the third coating the panel was dried for 1.5 hours at 33° C. A 3 by 9 inch (7.62 by 22.86 cm) abrasive sample was soaked in 70° F. (21.1° C.) tap water for 16 hours. The sample was then wrapped around a rubber hand block, type "HAND SAND BLOCK, PN 03149" from 3M Company, and secured on each end of the block with existing pins such that a 5 by 2.5 inch (12.7 by 6.35 cm) area was flat against the block. A preweighed surface primer coated panel was then manually abraded in 50 stroke intervals for a total of 200 strokes. Between each cycle, surface debris was brushed off the panel, the panel reweighed, and the sanding block briefly submerged into the water before beginning the next cycle. Total weight loss (cut) was calculated and final surface finish measured.

Cut Test 3.

Using a 2.25 by 4.25 inch die (5.72 by 10.8 cm), 3 test pieces were cut from left, center, and right across web of the abrasive sample. Double sided adhesive tape was applied to the abrasive backing using a rubber roller with pressure to ensure contact of the tape. An 18 by 30 inch by 32 mil (45.7 by 76.2 by 0.081 cm) black painted cold rolled steel panel, with an approximately 8 mil (0.2 mm) coating of primer, basecoat and clearcoat, obtained from ACT Laboratories, Inc., Hillsdale, Mich., was placed on a sanding platform. Sanding tracks, approximately 2.5 inches (6.45 cm) apart, were marked on the panel with a ruler and wax pencil. The abrasive sample was attached to weighted sand block sander with handle at 10 pounds (4.54 kg) by means of a pressure sensitive adhesive. The sample was wetted with sponge, the weighted block placed on the back of the track, water dripped onto on to the panel at a rate of 190 grams per 30 seconds and the sample sanding for 30 back and forth cycles. The sanding block was removed from the track, the water supply turned off, and the sanded surface was dried and the panel reweighed and the surface finish measured. The sanding process was then repeated for an additional 60 cycles, for a total of 90 cycles per sample, and the total weight loss (cut) was calculated and final surface finish of the panel measured.

Surface Finish Measurement.

The surface finish of a workpiece is defined by Rz and Ra. Rz is determined by calculating the arithmetic average of the magnitude of the departure (or distance) of the five tallest peaks of the profile from the meanline and by calculating the average of the magnitude of the departure (or distance) of the five lowest valleys of the profile from its meanline. These two averages are then added together to determine Rz. Ra, is the arithmetic mean of the magnitude of the departure (or distance) of the profile from its meanline. Both Rz and Ra were measured in three places on each of four replicates corresponding to four cut tests using a profilometer, available under the trade designation "SURTRONIC 25 PROFILOMETER" from Taylor Hobson, Inc., Leicester, England. The length of scan was 0.03 inches (0.0762 centimeters).

Epoxy Acrylate Make Coat Resin 1.

90.0 grams EPON-828, 63.3 grams UVR-6110, and 63.3 grams SR-351 were charged into a 16 oz. (0.47 liter) black plastic container and dispersed in the resin for 5 minutes at 70° F. (21.1° C.) using a high speed mixer. To that mixture, 1.5 grams W-985 was added and dispersed for 3 minutes at 70° F. (21.1° C.). With the mixer still running, 100.0 grams of MX-10 was gradually added over approximately 15 minutes. 6.3 grams CPI-6976 and 0.25 grams I-819 were added to the resin and dispersed until homogeneous (approximately 5 minutes). Finally, 3.0 grams CM-5 was gradually added over approximately 15 minutes until homogeneously dispersed.

Epoxy Acrylate Size Coat Resin 1.

400.0 grams EPON-828, 300.0 grams UVR-6110, and 300.0 grams SR-351 were charged into a 16 oz. (0.47 liter) black plastic container and dispersed in the resin for 5 minutes at 70° F. (21.1° C.) using the high speed mixer. To that mixture 30.0 grams CPI-6976 and 10.0 grams D-1173 were added and dispersed until homogeneous (approximately 10 minutes).

Epoxy Acrylate Make Coat Resin 2.

1551.2 grams UVR 6110, 664.8 grams SR-351 and 24.0 grams W985 were charged into a 128 oz. (3.79 liter) black plastic container and dispersed for 5 minutes at 70° F. (21.1° C.) using a high speed mixer. With the mixer still running, 1,600.0 grams MX-10 was gradually added over approximately 15 minutes. 120.0 grams CPI-6976 and 40.0 grams I-819 were added to the resin and dispersed until homogeneous, approximately 5 minutes. Finally, 32.0 grams CM-5 was gradually added over approximately 15 minutes until homogeneously dispersed.

Epoxy Acrylate Size Coat Resin 2.

2800.0 grams UVR-6100 and 1200.0 grams SR-351 were charged into a 128 oz. (3.79 liter) black plastic container and dispersed for 5 minutes at 70° F. (21.1° C.) using the high speed mixer. With the mixer still running, 125.0 grams CPI-6976 and 41.7 grams D-1173 were added to the resin and dispersed until homogeneous, approximately 5 minutes.

Example 1

A 23 inch by 31 inch (58.42 by 78.74 cm) aluminum framed flatbed polyester 158 screen printing mesh, having a 9 inch by 11 inch (22.86 by 27.94 cm) print area, a perforation diameter of 12 mils (0.305 mm) and a percent print area of 16%, was obtained from Photo Etch Technology, Lowell, Mass. The number of features per unit area was estimated at 1414 features/in$^2$ (219 features/cm$^2$). The framed mesh was mounted onto the screen printer and a 12 inch by 20 inch (30.48 by 50.8 cm) sheet of CWT paper was taped to the printer backing plate, and the plate secured in registration within the screen printer. Approximately 75 grams of Epoxy Acrylate Make Coat Resin 1, at 70° F. (21.1° C.), was spread over the mesh using a urethane squeegee and subsequently printed onto the paper backing.

The backing plate and coated paper assembly was immediately removed from the screen printer. FEPA-P150 mineral was evenly spread over a 10 inch by 18 inch (25.4 by 45.72 cm) metal plate to produce a mineral bed. The epoxy acrylate coated surface of the steel panel-film assembly was then suspended one inch (2.54 cm) above the mineral bed and the mineral electrostatically transferred to the coated surface by applying 10-20 kilovolts DC across the metal plate and the steel panel-film assembly. The sample was then passed through the UV processor at 16.4 ft/min (5.0 m/min), corresponding to a total dose of 2,814 mJ/cm$^2$, after which residual mineral was removed using a workshop vacuum with a bristle attachment, model "RIDGID WD14500", obtained from Emerson Electrical Co., St. Louis, Mo. The sample was removed from the printer backing plate, taped to a carrier web and Epoxy Acrylate Size Coat Resin 1, diluted to a 1:1 weight ratio in ethyl acetate, was applied using a roll coater at approximately 5 m/min. The roll coater, having a steel top roller and a 90 Shore A durometer rubber bottom roller immersed in the size coat, was obtained from Eagle Tool, Inc., Minneapolis, Minn. The diluted size coat resin was applied continuously over the patterned printed abrasive and discontinuously in the non-abrasive area of the paper. The coated paper was cured by passing once through a UV processor, available from American Ultraviolet Company, Murray Hill, N.J., using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (140° C.).

The sample was then subjected to Cut Test 1 and evaluated for finish according to the methods described above. Results are listed in Table 1.

Example 2

An abrasive sample was prepared according to the general procedure described in Example 1, wherein the screen used to apply the make resin had a feature diameter of 0.015 inch (0.38 mm) and a % print coverage area of 12%. The number of features per unit area was estimated at 679 features/in$^2$ (105 features/cm$^2$).

Example 3

An abrasive sample was prepared according to the general procedure described in Example 1, wherein the screen used to apply the make resin had a feature diameter of 0.015 inch (0.38 mm) and a print coverage area of 20%. The number of features per unit area was estimated at 1131 features/in$^2$ (175 features/cm$^2$).

Example 4

An abrasive sample was prepared according to the general procedure described in Example 1, wherein the screen used to apply the make resin had a feature diameter of 0.020 inch (0.51 mm) and a print coverage area of 10%. The number of features per unit area was estimated at 318 features/in$^2$ (49 features/cm$^2$).

Example 5

An abrasive sample was prepared according to the general procedure described in Example 1, wherein the screen used to apply the make resin had a feature diameter of 0.020 inch (0.51 mm) and a print coverage area of 16%. The number of features per unit area was estimated at 509 features/in$^2$ (79 features/cm$^2$).

Example 6

An abrasive sample was prepared according to the general procedure described in Example 1, wherein the screen used to apply the make resin had a feature diameter of 0.020 inch (0.51 mm) and a print coverage area of 20%. The number of features per unit area was estimated at 636 features/in$^2$ (99 features/cm$^2$).

Example 7

An abrasive sample was prepared according to the general procedure described in Example 1, wherein the screen used to apply the make resin had a feature diameter of 0.025 inch (0.64 mm) and a print coverage area of 12%. The number of features per unit area was estimated at 244 features/in$^2$ (38 features/cm$^2$).

Example 8

An abrasive sample was prepared according to the general procedure described in Example 1, wherein the screen used to apply the make resin had a feature diameter of 0.025 inch (0.64 mm) and a print coverage area of 20%. The number of features per unit area was estimated at 407 features/in$^2$ (63 features/cm$^2$).

Example 9

An abrasive sample was prepared according to the general procedure described in Example 1, wherein the screen used to apply the make resin had a feature diameter of 0.028 inch (0.64 mm) and a print coverage area of 16%. The number of features per unit area was estimated at 260 features/in$^2$ (40 features/cm$^2$).

TABLE 1

| Example | Feature Diameter (mm) | Screen Print Area (% Coverage) | Cut (grams) | Finish ($R_a$) (mil/μm) | Finish ($R_z$) (mil/μm) | Features per cm$^2$ (theoretical) |
|---|---|---|---|---|---|---|
| 1 | 0.3049 | 16 | 4.923 | 79.22/2.01 | 488.56/12.41 | 219 |
| 2 | 0.3812 | 12 | 4.974 | 84.58/2.15 | 517.75/13.15 | 105 |
| 3 | 0.3812 | 20 | 4.959 | 85.89/2.18 | 549.44/13.96 | 175 |
| 4 | 0.5082 | 10 | 4.139 | 75.44/1.92 | 464.89/11.81 | 49 |
| 5 | 0.5082 | 16 | 5.274 | 91.00/2.31 | 581.33/14.77 | 79 |
| 6 | 0.5082 | 20 | 5.161 | 83.89/2.13 | 510.50/12.97 | 99 |
| 7 | 0.6353 | 12 | 4.061 | 71.56/1.82 | 447.78/11.37 | 38 |
| 8 | 0.6353 | 20 | 4.728 | 81.50/2.07 | 499.50/12.69 | 63 |
| 9 | 0.7115 | 16 | 4.096 | 73.42/1.87 | 463.58/11.77 | 40 |

Example 10

The 23 inch by 31 inch (58.42 by 78.74 cm) aluminum framed flatbed polyester 158 screen printing mesh was mounted onto the screen printer and a 12 inch by 20 inch (30.48 by 50.8 cm) sheet of AWT paper was secured to the screen printer table via vacuum. Approximately 75 grams of Epoxy Acrylate Make Coat Resin 2, at 70° F. (21.1° C.), was spread over the mesh using a urethane squeegee and subsequently printed onto the paper backing. The paper was removed from the screen printer. FEPA-P320 mineral was evenly spread over a 14 inch by 20 inch (35.56 by 50.8 cm) plastic mineral tray to produce a mineral bed. The epoxy acrylate coated surface of the AWT paper was then suspended one inch (2.54 cm) above the mineral bed via vacuum and the mineral electrostatically transferred to the coated surface by applying 10-20 kilovolts DC across the metal plate and resin coated AWT paper. The sample was then passed through the UV processor at 16.4 ft/min (5.0 m/min.), corresponding to a total dose of 2,814 mJ/cm$^2$, after which residual mineral was removed using a dry paint brush. Epoxy Acrylate Size Coat Resin 2 was applied over select areas of the sheet via a kiss coating process using the roll coater, at 60° C. and about 5 m/min., metered using a Number 18 Mayer Rod. The rubber roll had a durometer of approximately 70 Shore A. The gap between the coated rubber roll and the steel roll was approximately 5 mils (125 μm). The sheet was inserted into the roll coater such that the pattern coated abrasive features dipped into the size resin on the rubber roll without having the size resin coating the non abrasive coated areas of the sheet. The size resin was substantially in registration with the abrasive coated make resin. The coated paper was cured by passing once through the UV processor, using two V-bulbs in sequence operating at 400 W/inch (157.5 W/cm) and a web speed of 40 ft/min (12.19 m/min), corresponding to a total dose of approximately 894 mJ/cm$^2$, followed by thermally curing for 5 minutes at 284° F. (14° C.).

Example 11

An abrasive sample was prepared according to the general procedure described in Example 10, wherein the 158 mesh screen was substituted with a 230 mesh screen. Samples were subjected to Cut Test 2 and evaluated for finish according to the methods described above. Results are listed in Table 2.

TABLE 2

| Example | Feature Diameter (inch) | Screen Print Area (% Coverage) | Make Height (μm) | Cut (grams) | Finish ($R_a$) (mil/μm) |
|---|---|---|---|---|---|
| 10 | 0.012 | 16 | 37 | 7.5 | 23.0/0.58 |
| 11 | 0.012 | 16 | 32 | 7.3 | 20.0/0.51 |

Example 12

An abrasive sample was prepared according to the general procedure described in Example 10, wherein the make coat resin contained 0.05% by weight UVPC.

Example 13

An abrasive sample was prepared according to the general procedure described in Example 12, wherein the 158 mesh screen was substituted with a 230 mesh screen.

Example 14

An abrasive sample was prepared according to the general procedure described in Example 13, wherein the 230 mesh screen was substituted with a 390 mesh screen.

Example 15

An abrasive sample was prepared according to the general procedure described in Example 12, wherein the FEPA-P320 mineral was replaced with FEPA-P600, and the Number 18 Mayer Rod was replaced with a Number 6 Mayer Rod.

Example 16

An abrasive sample was prepared according to the general procedure described in Example 15, wherein the 158 mesh screen was substituted with a 230 mesh screen.

Example 17

An abrasive sample was prepared according to the general procedure described in Example 16, wherein the 230 mesh screen was substituted with a 390 mesh screen. Samples 12-17 were subjected to Cut Test 3 and evaluated for finish according to the methods described above. Results are listed in Table 3.

TABLE 3

| Example | Mineral | Screen Mesh | Make Height (μm) | Cut (grams) | Finish (Ra) (mil/μm) |
|---|---|---|---|---|---|
| 12 | P320 | 158 | 40.64 | 1.460 | 37.44/0.95 |
| 13 | P320 | 230 | 30.48 | 1.330 | 36.78/0.93 |
| 14 | P320 | 390 | 15.24 | 1.270 | 33.11/0.84 |
| 15 | P600 | 158 | 40.64 | 0.980 | 17.33/0.44 |
| 16 | P600 | 230 | 30.48 | 1.013 | 17.44/0.44 |
| 17 | P600 | 390 | 15.24 | 0.953 | 17.78/0.45 |

The following various embodiments are further contemplated:

A. An abrasive article having a flexible backing having a major surface; a make resin contacting the major surface and extending across the major surface in a pre-determined pattern; abrasive particles contacting the make resin and generally in registration with the make resin as viewed in directions normal to the plane of the major surface; and a size resin contacting both the abrasive particles and the make resin, the size resin being generally in registration with both the abrasive particles and the make resin as viewed in directions normal to the plane of the major surface, where areas of the major surface contacting the make resin are generally coplanar with areas of the major surface not contacting the make resin, and where the pre-determined pattern has a multiplicity of features having an areal density ranging from about 30 features to about 300 features per square centimeter and an average feature diameter ranging from about 0.1 millimeters to about 1.5 millimeters.

B. An abrasive article having a flexible backing having a major surface; a make resin contacting the major surface and extending across the major surface in a pre-determined pattern, the make resin layer having an average make layer thickness; abrasive particles contacting the make resin and generally in registration with the make resin as viewed in directions normal to the plane of the major surface, the abrasive particles having an average abrasive particle size ranging from about 20 micrometers to about 250 micrometers and the average make layer thickness ranging from 33 percent to 100 percent of the average abrasive particle size; and a size resin contacting both the abrasive particles and the make resin, the size resin being generally in registration with both the abrasive particles and the make resin as viewed in directions normal to the plane of the major surface, where areas of the major surface contacting the make resin are generally coplanar with areas of the major surface not contacting the make resin.

C. The abrasive article of embodiment B, where the pre-determined pattern has a multiplicity of features having an areal density ranging from about 30 features to about 300 features per square centimeter and an average feature diameter ranging from about 0.1 millimeters to about 1.5 millimeters.

D. An abrasive article having a flexible backing having a generally planar major surface; and a plurality of discrete islands on the major surface arranged according to a two-dimensional pattern, each island having a make resin contacting the backing; abrasive particles contacting the make resin; and a size resin contacting the make resin, the abrasive particles, and the backing, where areas of the major surface surrounding the islands do not contact the make resin, abrasive particles, or size resin, and where the pre-determined pattern has a multiplicity of features having an areal density ranging from about 30 features to about 300 features per square centimeter and an average feature diameter ranging from about 0.1 millimeters to about 1.5 millimeters.

E. An abrasive article having a flexible backing having a generally planar major surface; and a plurality of discrete islands on the major surface arranged according to a two-dimensional pattern, each island having a make resin contacting the backing, the make resin layer having an average make layer thickness; abrasive particles contacting the make resin, the abrasive particles having an average abrasive particle size ranging from about 20 micrometers to about 250 micrometers and the average make layer thickness ranging from 33 percent to 100 percent of the average abrasive particle size; and a size resin contacting the make resin, the abrasive particles, and the backing, where areas of the major surface surrounding the islands do not contact the make resin, abrasive particles, or size resin.

F. The abrasive article of embodiment E, where the two-dimensional pattern has a multiplicity of features having an areal density ranging from about 30 features to about 300 features per square centimeter and an average feature diameter ranging from about 0.1 millimeters to about 1.5 millimeters.

G. The abrasive article of embodiment A, C, D, or F, where the average feature diameter ranges from about 0.15 millimeters to about 1 millimeter.

H. The abrasive article of embodiment G, where the average feature diameter ranges from about 0.25 millimeters to about 1.5 millimeters.

I. The abrasive article of embodiment B, C, E, or F, where the average make layer thickness ranges from about 40 percent to about 80 percent of the average abrasive particle size.

J. The abrasive article of embodiment I, where the average make layer thickness ranges from about 50 percent to about 60 percent of the average abrasive particle size.

K. The abrasive article of any of embodiments A-J, further having a supersize resin contacting the size resin and generally in registration with the size resin as viewed in directions normal to the plane of the major surface, the supersize resin providing enhanced lubricity.

L. The abrasive article of any of embodiments A-J, where the abrasive particles have an average abrasive particle size ranging from about 70 micrometers to about 250 micrometers and the make resin covers at most 30 percent of the major surface.

M. The abrasive article of embodiment L, where the average abrasive particle size ranges from about 70 micrometers to about 250 micrometers and the make resin covers at most 20 percent of the major surface.

N. The abrasive article of embodiment M, where the average abrasive particle size ranges from about 70 micrometers to about 250 micrometers and the make resin covers at most 10 percent of the major surface.

O. The abrasive article of any of embodiments A-J, where the abrasive particles have an average abrasive particle size ranges from about 20 micrometers to 70 micrometers and the make resin covers at most 70 percent of the major surface.

P. The abrasive article of embodiment O, where the average abrasive particle size ranges from about 20 micrometers to 70 micrometers and the make resin covers at most 60 percent of the major surface.

Q. The abrasive article of embodiment P, where the average abrasive particle size ranges from about 20 micrometers to 70 micrometers and the make resin covers at most 50 percent of the major surface.

R. The abrasive article of any of embodiments A-J, where the pattern has a plurality of replicated polygonal clusters.

S. The abrasive article of embodiment R, where each polygonal cluster has three or more generally circular features.

T. The abrasive article of embodiment S, where each polygonal cluster is a hexagonal cluster of seven generally circular features.

U. The abrasive article of any of embodiments A-J, where the pattern is a random array of generally circular features.

V. The abrasive article of any of embodiments A-J, where essentially all of the abrasive particles are encapsulated by the combination of the make and size resins.

W. The abrasive article of any of embodiments A-J, where an 11.4 centimeter by 14.0 centimeter sheet of the abrasive article that is conditioned at 32.2 degrees centigrade and 90% relative humidity for 4 hours displays a curl radius of at least 20 centimeters.

X. The abrasive article of embodiment W, where the sheet displays a curl radius of at least 50 centimeters.

Y. The abrasive article of embodiment X, where the sheet displays a curl radius of at least 100 centimeters.

All of the patents and patent applications mentioned above are hereby expressly incorporated by reference. Figures provided and referred to herein may not be to scale. The embodiments described above are illustrative of the present invention and other constructions are also possible. Accordingly, the present invention should not be deemed limited to the embodiments described in detail above and shown in the accompanying drawings, but instead only by a fair scope of the claims that follow along with their equivalents.

What is claimed is:

1. An abrasive article comprising:

a flexible backing having a major surface;

a make resin contacting the major surface and extending across the major surface in a pre-determined pattern;

abrasive particles contacting the make resin and generally in registration with the make resin as viewed in directions normal to the plane of the major surface; and a size resin contacting both the abrasive particles and the make resin, the size resin being generally in registration with both the abrasive particles and the make resin as viewed in directions normal to the plane of the major surface, wherein areas of the major surface contacting the make resin are generally coplanar with areas of the major surface not contacting the make resin, and wherein the pre-determined pattern comprises a multiplicity of features having an areal density ranging from about 30 features to about 300 features per square centimeter and an average feature diameter ranging from about 0.1 millimeters to about 1.5 millimeters.

2. An abrasive article comprising:

a flexible backing having a major surface;

a make resin contacting the major surface and extending across the major surface in a pre-determined pattern, the make resin layer having an average make layer thickness;

abrasive particles contacting the make resin and generally in registration with the make resin as viewed in directions normal to the plane of the major surface, the abrasive particles having an average abrasive particle size ranging from about 20 micrometers to about 250 micrometers and the average make layer thickness ranging from 33 percent to 100 percent of the average abrasive particle size; and a size resin contacting both the abrasive particles and the make resin, the size resin being generally in registration with both the abrasive particles and the make resin as viewed in directions normal to the plane of the major surface, wherein areas of the major surface contacting the make resin are generally coplanar with areas of the major surface not contacting the make resin.

3. The abrasive article of claim 2, wherein the pre-determined pattern comprises a multiplicity of features having an areal density ranging from about 30 features to about 300 features per square centimeter and an average feature diameter ranging from about 0.1 millimeters to about 1.5 millimeters.

4. An abrasive article comprising:

a flexible backing having a generally planar major surface; and a plurality of discrete islands on the major surface arranged according to a two-dimensional pattern, each island comprising:

a make resin contacting the backing;

abrasive particles contacting the make resin; and a size resin contacting the make resin, the abrasive particles, and the backing, wherein areas of the major surface surrounding the islands do not contact the make resin, abrasive particles, or size resin, and wherein the pre-determined pattern comprises a multiplicity of features having an areal density ranging from about 30 features to about 300 features per square centimeter and an average feature diameter ranging from about 0.1 millimeters to about 1.5 millimeters.

5. An abrasive article comprising:

a flexible backing having a generally planar major surface; and a plurality of discrete islands on the major surface arranged according to a two-dimensional pattern, each island comprising:

a make resin contacting the backing, the make resin layer having an average make layer thickness;

abrasive particles contacting the make resin, the abrasive particles having an average abrasive particle size ranging from about 20 micrometers to about 250 micrometers and the average make layer thickness ranging from 33 percent to 100 percent of the average abrasive particle size; and a size resin contacting the make resin, the abrasive particles, and the backing, wherein areas of the major surface surrounding the islands do not contact the make resin, abrasive particles, or size resin.

6. The abrasive article of claim 5, wherein the two-dimensional pattern comprises a multiplicity of features having an areal density ranging from about 30 features to about 300 features per square centimeter and an average feature diameter ranging from about 0.1 millimeters to about 1.5 millimeters.

7. The abrasive article of claim 6, wherein the average feature diameter ranges from about 0.25 millimeters to about 1.5 millimeters.

8. The abrasive article of claim 2, wherein the average make layer thickness ranges from about 40 percent to about 80 percent of the average abrasive particle size.

9. The abrasive article of claim 8, wherein the average make layer thickness ranges from about 50 percent to about 60 percent of the average abrasive particle size.

10. The abrasive article of claim 1, further comprising a supersize resin contacting the size resin and generally in registration with the size resin as viewed in directions normal to the plane of the major surface, the supersize resin providing enhanced lubricity.

11. The abrasive article of claim 1, wherein the abrasive particles have an average abrasive particle size ranging from about 70 micrometers to about 250 micrometers and the make resin covers at most 30 percent of the major surface.

12. The abrasive article of claim 11, wherein the average abrasive particle size ranges from about 70 micrometers to about 250 micrometers and the make resin covers at most 10 percent of the major surface.

13. The abrasive article of claim 1, wherein the abrasive particles have an average abrasive particle size ranges from about 20 micrometers to 70 micrometers and the make resin covers at most 70 percent of the major surface.

14. The abrasive article of claim 13, wherein the average abrasive particle size ranges from about 20 micrometers to 70 micrometers and the make resin covers at most 50 percent of the major surface.

15. The abrasive article of claim 1, wherein the pattern comprises a plurality of replicated polygonal clusters.

16. The abrasive article of claim 1, wherein the pattern is a random array of generally circular features.

17. The abrasive article of claim 1, wherein essentially all of the abrasive particles are encapsulated by the combination of the make and size resins.

* * * * *